US005338569A

United States Patent [19]

Hatch

[11] Patent Number: 5,338,569

[45] Date of Patent: Aug. 16, 1994

[54] PROCESS FOR COATING DOWELS WITH WATER SOLUBLE GLUE

[76] Inventor: J. Mel Hatch, 4850 S. Hidden Cove Cir., Murray, Utah 84123

[21] Appl. No.: 47,711

[22] Filed: Apr. 14, 1993

[51] Int. Cl.[5] ..... B05D 5/10; B05D 7/06

[52] U.S. Cl. ..... 427/212; 427/242; 427/346; 427/378; 118/57; 118/416; 118/417; 118/56; 118/610

[58] Field of Search ..... 427/3, 212, 242, 346, 427/378, 393, 397; 118/56, 57, 610, 612, 416, 417, 418, DIG. 3

[56] References Cited

U.S. PATENT DOCUMENTS

| | | | |
|---|---|---|---|
| 3,066,045 | 11/1962 | Lewis | 427/242 |
| 3,091,435 | 5/1963 | Pease | 118/418 |
| 3,573,966 | 4/1971 | Hostetler | 427/242 |
| 3,927,467 | 12/1975 | Schoeman | 29/526 |
| 4,311,111 | 1/1982 | Inaba | 118/56 |
| 4,431,757 | 2/1984 | Okitsu et al. | 524/25 |
| 5,190,997 | 3/1993 | Lindermann et al. | 524/44 |

*Primary Examiner*—Shrive Beck

*Assistant Examiner*—Brian K. Talbot

*Attorney, Agent, or Firm*—Terry M. Crellin

[57] ABSTRACT

A method is disclosed for coating dowels with a substantially uniform coat of water soluble glue. A plurality of dowels and a preselected amount of liquid, water soluble glue are placed in a closed container. The container is rapidly shaken so that the container moves in a combination oscillating motion comprising an up and down movement and a back and forth movement that is substantially perpendicular to the up and down movement. Dowels coated with the liquid, water soluble glue are removed from the container and deposited on a drying surface. The dowels are dried by applying heat and a stream of air to the dowels. When the exposed surface of the coat of water soluble glue on the dowels has become essentially tack free but before the coat has dried completely, the dowels are rotated about their longitudinal axes so as to separate any dowels that are stuck together and to free any dowels stuck to the drying surface. The drying is then continued until the dowels can be accumulated in a mass without sticking to each other.

7 Claims, 2 Drawing Sheets

PROCESS FOR COATING DOWELS WITH WATER SOLUBLE GLUE

BACKGROUND OF THE INVENTION

1. Field of the Invention

The present invention relates to wooden dowels that have a self-contained, integral coating of a water soluble glue on the external surface of the dowels. In particular, the present invention relates to a process and apparatus for coating such dowels with the water soluble glue.

2. State of the Art

In production of cabinets, furniture and other similar items from wood, adjoining pieces of wood are held securely together with wooden dowels. Dowel receiving cavities are formed in each of the respective pieces of wood that are to be held together. When the pieces of wood are assembled, liquid glue is injected into the dowel receiving cavities. To be sure that sufficient glue is used in each cavity an excess of glue is used in each cavity. When the dowel is inserted, glue is expelled from the cavity. The expelled glue creates a messy situation with glue getting on everything around the pieces of wood as well as on to the pieces of wood themselves. Cleaning of the glue is a major labor item and adds to the cost of the wood items being produced. However, manufacturers have found that the use of excess amounts of glue is essential. When the excess of glue is cut back, many of the dowel connections for one reason or another become weak due to insufficient or improper distribution of glue around the dowels in the cavities.

In my copending U.S. patent application Ser. No. 07/766,590 filed 9/21/91, now U.S. Pat. No. 5,259,686 there is disclosed wooden dowels having an external coating of a water soluble glue. These dowels have been found to be preferable to ordinary dowels in many applications. Instead of introducing an excess of messy glue into the cavities of wood pieces that are to be held together by the dowels, manufacturers introduce water into the cavities. The dowels that are precoated with a water soluble glue are then inserted into the cavities expelling excess water instead of excess glue from the cavities.

The precoated dowels of my previous application were made by a labor intensive, manual operation. To be commercially viable, a less labor intensive, mechanized method and apparatus had to be developed.

OBJECTIVES

A principal objective of the invention is to provide a mechanized method and apparatus for coating the external surfaces of wooden dowels with a substantially uniform coating of water soluble glue.

BRIEF DESCRIPTION OF THE INVENTION

The above objective is achieved in accordance with the present invention by providing a novel method and apparatus for coating the external surfaces of wooden dowels with a substantially uniform coating of a water soluble glue. The invention comprises a novel apparatus for applying a substantially uniform coating of water soluble glue to the surfaces of the wooden dowels. The apparatus is used in a novel method for coating large numbers of dowels in a mechanized procedure that does not require the extensive hand labor required of manual processes.

The novel apparatus comprises a mixing drum that moves up and down in rapid vertical oscillation. In addition to the vertical movement, the mixing drum further rapidly oscillates in a direction perpendicular to the up and down motion. A batch of dowels and sufficient liquid glue to coat the dowels in the batch are introduced into the mixing drum. The mixing drum is oscillated in its dual movement fashion until the dowels are substantially uniformly coated with the liquid glue.

The wet, coated dowels are dumped from the mixing drum and allowed to dry under the action of heat and air circulation. The wet dowels are deposited on a drying surface and dried under the action of heat and moving air. When the dowels have partially dried such that the external surface of the glue coating becomes essentially free of tack on its exterior surface, the dowels are subjected to movement such that they are rotated about their longitudinal axes. The rotational movement of the dowels causes any dowels that are stuck to each other to break apart. In addition, the movement of the dowels frees any dowels that are otherwise stuck to the drying surface. Upon being broken free of the drying surface and from being stuck to each other, the dowels are allowed to continue to dry until the glue in the coating is essentially tack free throughout the depth of the coating.

Additional objects and features of the invention will become apparent from the following detailed description, taken together with the accompanying drawings.

THE DRAWINGS

Novel mixing apparatus and agitation unit which are advantageously used in practicing the method of the present invention are illustrated in the accompanying drawing, in which:

FIG. 1 is a diagrammatic illustration of a dual action mixing drum for mixing liquid glue and wooden dowels to coat the wooden dowels with a substantially uniform coating of the liquid glue; and FIG. 2 is a diagrammatic illustration of an agitation unit that is used to move the glue coated dowels as they dry so that the dowels do not stick to other dowels or to the drying surface.

DETAILED DESCRIPTION OF THE ILLUSTRATED EMBODIMENT

As mentioned previously, a principal objective of the present invention is to provide a mechanized method and appropriate apparatus for coating wooden dowel with a uniform coating of a water soluble glue. The first step of the novel process of the present invention comprises introducing the batch of dowels that are to be coated into a closed container along with sufficient liquid glue to coat the dowels to the desired degree. The water soluble glue advantageously comprises a composition containing vinyl acetate homopolymer or polyvinyl acetate emulsion. An applicable vinyl acetate homopolymer is commercially available from H. B. Fuller Company in St. Paul, Minn. and the polyvinyl acetate emulsion is commercially available from Atwood Adhesives in Seattle, Wash. The amount of glue that is added to the batch of dowels in the container preferably is between about 0.75 and 1.25 ounces of glue to 300 square inches of total surface area of the dowels in the batch. Most preferably, the amount of glue used is about one ounce to 300 square inches of total surface area of the dowels in the batch.

The container is then rapidly shaken in an oscillatory movement in which the container moves in a combination oscillating motion comprising a vertical, up and down movement and a horizontal movement that is perpendicular to the up and down vertical movement. The shaking motion comprises repeated cycles, with each cycle consisting of one up and down vertical stroke and one concurrent horizontal stroke, with the horizontal stroke being in a direction that is perpendicular to the up and down, vertical stroke. The shaking of the container is rather rapid. Advantageously, the container is shaken at a speed of about 100 to 200 cycles per minute, and most preferably at a speed of about 150 cycles per minute. It has been found that to obtain maximum efficiency in the mixing of the glue with the dowels, that the container be filled to no more than one-half of its capacity by the batch of dowels being mixed with the glue in the container.

The travel of the container in the vertical up and down component of each cycle is between about 1 inch and 6 inches. It has been found that the apparatus operates well when using a vertical travel of about 4 inches, and very good coating results with a mixing time of between 30 seconds and one minute. When using vertical strokes less than 4 inches in length, the mixing time will be increased. Using strokes of more than about 6 inches requires heavier equipment and does not appear to be any more beneficial than using strokes of about 4 to 6 inches in length. In addition to the vertical up and down motion, the container travels in a horizontal motion perpendicular to the vertical up and down motion. The distance that the container moves in the horizontal motion is at least about the same as the distance that the container moves in the vertical motion.

Figure 1:
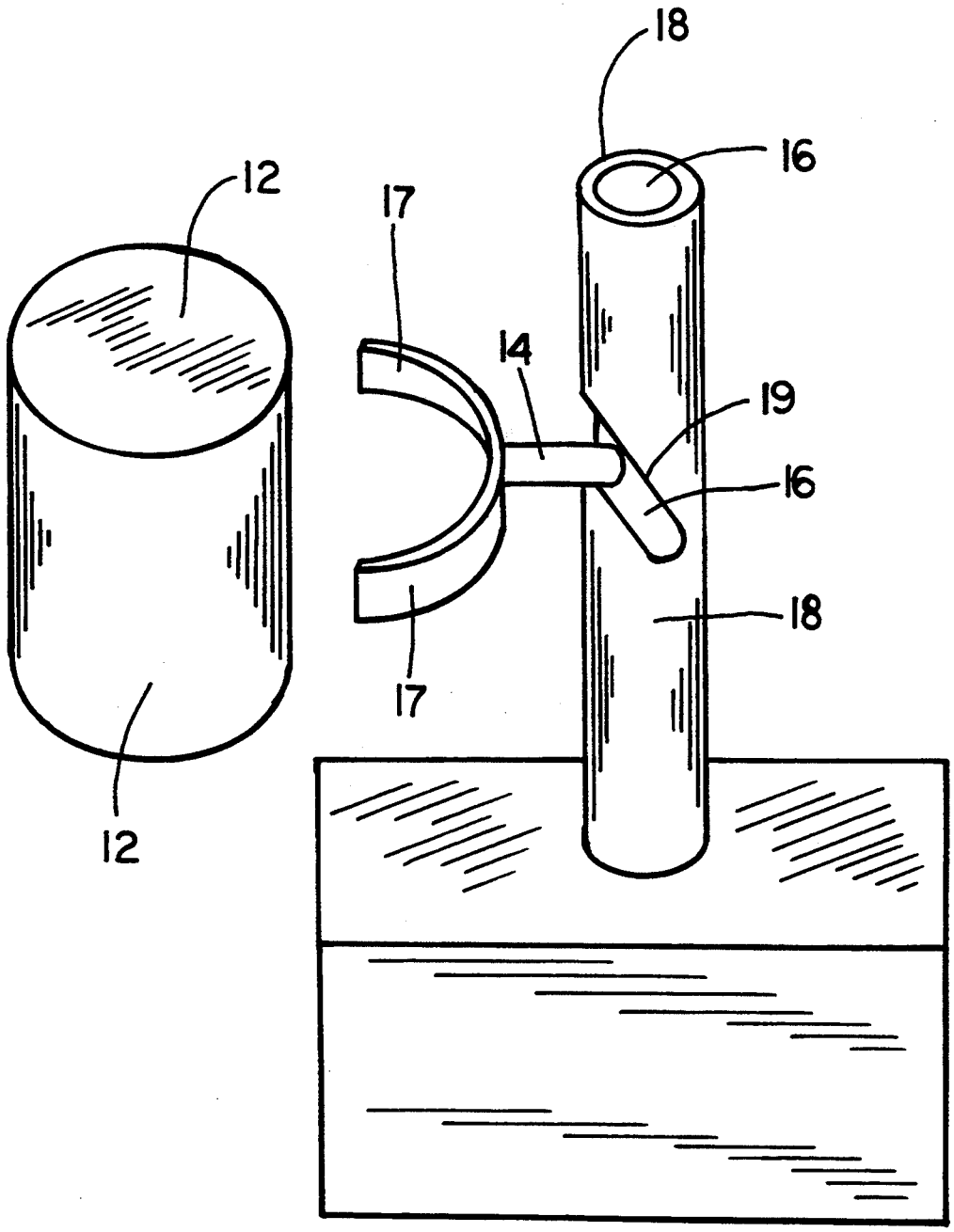

In FIG. 1 there is shown diagrammatically an apparatus that has been found to be advantageous for shaking and mixing the glue with the dowels. The container 12 can be any type container that has a closable lid. The container 12 is mounted on a motion arm 14 which is in turn mounted to an elongate motion imparting member 16. The motion imparting member 16 moves longitudinally up and down within a sleeve 18. As the motion imparting member 16 moves up and down, it also pivots or rotates back and forth about its longitudinal axis. As the member 16 moves up and down and rotates back and forth, it moves the motion arm 14 up and down and back and forth in a curved slot 19 in the sleeve 18. In addition to the up and down motion, the motion arm 14 is guided in a swinging arc movement about the axis of the motion imparting member 16 by the rotational movement of the motion imparting member 16 and by the travel of the motion arm 14 in the slot 19.

Advantageously, the motion arm 14 moves about its end that is connected to the motion imparting member 16 in an arc of about 90 degrees. The motion arm 14 moves in repeating cycles, each cycle comprising one up and down stroke and one back and forth arcuate stroke. The length of the motion arm 14 need not be much over 2 to 4 inches. Such a radius for the rotational movement provides adequate horizontal movement of the container 12. Advantageously, the free end of the motion arm 14 is provided with a circular yoke in which the container 12 is received. A strap (not shown in the drawings) can be attached around the container 12 from one end of the yoke to the other to hold the container 12 firmly to the motion arm 14.

After the mixing container has been shaken for a time sufficient to coat the dowels with the liquid glue, the dowels coated with the wet glue are deposited on a drying surface. An air flow is provided over the wet coated dowels as well as applying heat to the dowels to dry the wet coating of glue thereon. Advantageously, the wet coated dowels are deposited on a moving belt. The belt moves through a drying tunnel in which a flow of air is blown over the dowels on the belt. Further, heating means are provided in the tunnel to apply heat to the dowels as they move through the drying tunnel. The heating means can conveniently be infrared heat lamps, but heating the air that is blown over the dowels can also be employed as the means of applying heat to the dowels.

The dowels are advantageously distributed in a layer being as close to a single dowel thickness as possible when the dowels are deposited on the drying surface. The dowels tend to stick to themselves as well as the drying surface as they are being dried. It is imperative that the dowels be physically broken away from the belt and each other just as the surface of the glue on the dowels becomes tack free but before the coating of glue has dried completely. If one waits until the glue dries completely, the dowels are stuck so securely to the drying surface and to themselves that the wood in the dowel splinters when it is attempted to remove the dowels from the drying surface or from one another.

When using a moving belt, a thin scraping knife can be employed so as to extend across the belt. The knife scrapes the glue coated dowels from the drying surface as the belt moves past the knife. The dowels will move over the thin scraping surface by the accumulation of dowels moving on the belt toward the scraping surface. This scraping of dowels from the drying surface does not, unfortunately, result in adequate breaking of dowels which are stuck to one another. Thus, after the dowels are scraped from the drying surface, the individual dowels are made to rotate about their longitudinal axis. This will separate any dowel that is stuck to another dowel. The dowels can advantageously be made to rotate by applying a flat, vibrating surface to the top of the dowels as they move on the drying belt. The flat vibrating surface makes forceful contact with the dowels, and the vibrating motion of the vibrating surface forces the dowels to rotate slightly about their longitudinal axis. This slight rotational movement is sufficient to break any dowel that is stuck to another dowel.

In place of using the thin scraping knife, it is possible to use the vibrating surface to separate dowels that are stuck to each other as well as to free dowels which are stuck to the drying surface. The rotational motion imparted to the dowels will free dowels that are struck to the drying belt as well as separate dowels that are stuck to each other.

Figure 2:
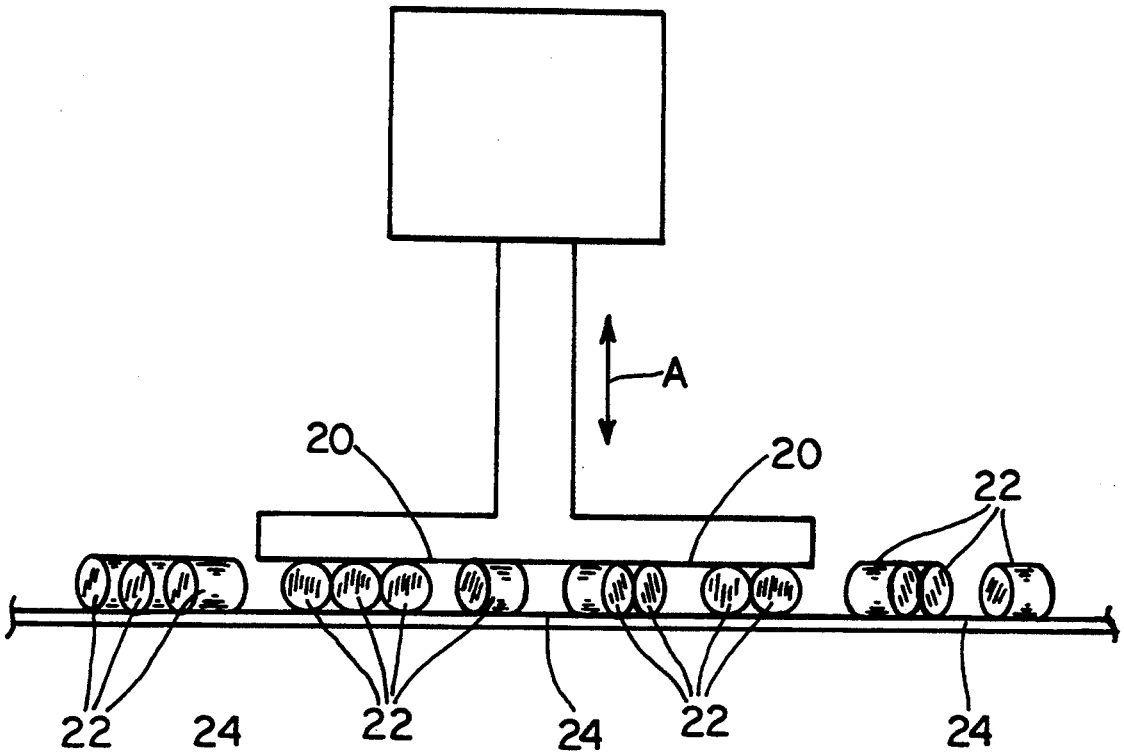

In FIG. 2 there is shown diagrammatically apparatus that has been found to be advantageous for applying vibratory force to the dowels to separate any dowels that are stuck to each other or free dowels that are stuck to the drying surface. The apparatus comprises a flat vibrating surface 20 that can come into contact with the dowels 22 on the drying belt 24. Preferably, the vibrating motion is orbital in a plane parallel to the surface of the drying belt, with the vibrating surface 20 in contact with the layer of dowels on the drying belt 24. Advantageously, the flat vibrating surface 20 is provided with means for moving up and down vertically in the direction shown by the arrows "A" so that the vibrating surface 20 cycles between alternate contact with the dowels and no contact as the vibrating surface 20 is lifted above the dowels. The vibrating force that is applied to the dowels 22 in successive cycles as the vibrating surface 20 contacts the dowels forces the dowels to move in a slight rotational movement about the longitudinal axes of the dowels. If adjacent dowels are stuck to each other, or if the dowels are stuck to the surface of the drying belt 24, this slight rotational movement is all that is necessary to separate the dowels from each other and free the dowels from sticking to the surface of the drying belt.

It has been found advantageous to provide some limited agitation to the dowels after they are separated from each other with the flat vibrating surface. This can be done by providing a series of pegs that extend toward the drying belt and move back and forth in a direction transverse of the travel of the drying belt. The moving pegs provide continuous agitation to the dowels until the coating of glue on the dowels has dried essentially completely. Other means of continuous agitation can be air jets injected through a porous drying belt.

Although preferred embodiments of the present invention have been illustrated and described, it is to be understood that the present disclosure is made by way of example and that various other embodiments are possible without departing from the subject matter coming within the scope of the following claims, which subject matter is regarded as the invention.

I claim:

1. A method for coating dowels with a substantially uniform coat of water soluble glue, said method comprising the steps of placing a plurality of dowels and a preselected amount of liquid, water soluble glue in a closed container;

shaking the container such that the container moves in a combination oscillating motion comprising an up and down movement and a back and forth movement that is substantially perpendicular to the up and down movement, said container being shaken for a time sufficient to cover the dowels with a substantially uniform coat of the liquid, water soluble glue;

depositing the dowels coated with the liquid, water soluble glue on a drying surface;

applying heat and a stream of air to an exposed surface of the dowels on the drying surface;

when the exposed surface of the coat of water soluble glue on the dowels has become essentially tack free but before the coat has dried completely, dislodging the dowels from the drying surface such that the dowels are not adherent to the drying surface and forcing individual dowels to rotate about their longitudinal axis whereby any dowels that are stuck to each other will be separated into free individual dowels; and continuing to dry the dowels until the dowels can be accumulated in a mass without sticking to each other.

2. A method in accordance with claim 1 wherein the container is filled to no more than one-half the capacity of the container with the dowels.

3. A method in accordance with claim 1 wherein the container is shaken at a rate of between about 100 to 200 cycles per minute, wherein each cycle includes one up and down stroke and one back and forth stroke.

4. A method in accordance with claim 3 wherein the container moves a distance of between about 1 inch and 6 inches in each of its up and down stroke and one back and forth stroke.

5. A method in accordance with claim 1 wherein the coated dowels from the shaking step are deposited on a moving belt which forms the drying surface.

6. A method in accordance with claim 5, wherein dislodging of the dowels from the moving belt and from each other is done by pressing a flat vibrating surface against the dowels with sufficient force applied by the vibrating surface to rotate the dowels on the belt about the longitudinal axes of the dowels.

7. A method in accordance with claim 6, wherein the flat vibrating surface moves in a cyclic manner toward and away from said dowels on said belt, so that said vibrating surface makes contact with the dowels in the portion of the cycle when it moves toward said dowels and is out of contact with said dowels when it moves away from said dowels.

* * * * *